US006731157B2

(12) United States Patent
Fulkerson

(10) Patent No.: US 6,731,157 B2
(45) Date of Patent: May 4, 2004

(54) ADAPTIVE THRESHOLD VOLTAGE CONTROL WITH POSITIVE BODY BIAS FOR N AND P-CHANNEL TRANSISTORS

(75) Inventor: David E. Fulkerson, Chanhassen, MN (US)

(73) Assignee: Honeywell International Inc., Morristown, NJ (US)

( * ) Notice: Subject to any disclaimer, the term of this patent is extended or adjusted under 35 U.S.C. 154(b) by 212 days.

(21) Appl. No.: 10/050,469

(22) Filed: Jan. 15, 2002

(65) Prior Publication Data

US 2003/0132735 A1 Jul. 17, 2003

(51) Int. Cl.[7] ..... G05F 3/02
(52) U.S. Cl. ..... 327/537
(58) Field of Search ..... 327/534, 535, 327/537; 323/281, 312

(56) References Cited

U.S. PATENT DOCUMENTS 5,216,385 A * 6/1993 McDaniel ..... 330/282
5,329,184 A * 7/1994 Redfern ..... 326/66
5,394,934 A 3/1995 Farrenkopf et al.
5,539,351 A * 7/1996 Gilsdorf et al. ..... 327/379

FOREIGN PATENT DOCUMENTS

EP 1081573 A 3/2001

OTHER PUBLICATIONS

Author: Masaharu Kubo, Ryoichi Hori, Osamu Minto and Kikuji Sato Title: "A Threshold Voltage Controlling Circuit For Short Channel MOS Integrated Circuits", 1976 International Solid State Circuit Conference of IEEE (all pages), no month.

Author: Tsuguo Kobayashi and Takayasu Sakurai Title: "Self–Adjusting Threshold–Voltage Scheme (SATS for Low–Voltage High–Speed Operation", 1994 Customer Integrated Circuits Conference (all pages), no month.

Author: Ricardo Gonzalez, Benjamin M. Gordon and Mark A. Horowitz Title: "Supply and Threshold Voltage Scaling For Low Power CMOS", IEEE Journal of Solid State Circuits, vol. 12, No. 2, Aug. 1997 (all pages).

* cited by examiner

*Primary Examiner*—Jessica Han
(74) *Attorney, Agent, or Firm*—Matthew Luxton

(57) ABSTRACT

A threshold control circuit for CMOS transistors wherein the voltage on the body of an n-channel reference transistor is controlled with a feedback circuit to produce a positive voltage on the body and decrease the threshold of the reference transistor to a desired value and the voltage on the body of a p-channel reference transistor is controlled with a feedback circuit to produce a negative voltage on the body and decrease the threshold of the reference transistor to a desired value.

32 Claims, 2 Drawing Sheets

ID (mAMPS)
VG (VOLTS)
BODY VOLTAGE
+0.5
0.0
-0.5
-1.0
-1.5
-2.0
-2.5
10N
11N
12N
13N
14N
15N
16N
20

ID (mAMPS)
VG (VOLTS)
BODY VOLTAGE
-0.5
0.0
+0.5
+1.0
+1.5
+2.0
+2.5
10P
11P
12P
13P
14P
15P
16P
20

Relative Delay
$V_{DD}$
Controlled,
VT max. hot = 0.68v
VT max. cold = 0.75v
Uncontrolled,
VTmax. hot =0.83v,
VTmax. cold =0.97v
22
24
26

ADAPTIVE THRESHOLD VOLTAGE CONTROL WITH POSITIVE BODY BIAS FOR N AND P-CHANNEL TRANSISTORS

BACKGROUND OF THE INVENTION

1. Field of the Invention

This invention relates to the field of threshold voltage control and, more particularly, to the control of the threshold voltage of a transistor with a feedback control system, to bias the transistor body voltage in such a way as to reduce the threshold voltage to a desired value.

2. Description of the Prior Art

In the last few years, the desire to lower the power supply voltages applied to integrated circuits, ICs, and thus reduce the power consumption while maintaining high reliability, has resulted in a significant decrease in the speed of the ICs. There have been attempts, in the prior art, to alleviate this problem by controlling the threshold value of the transistors. In the 1976 International Solid State Circuit Conference of IEEE, an article entitled "A Threshold Voltage Controlling Circuit for Short Channel MOS Integrated Circuits" by Masaharu Kubo, Ryoachi Hori, Osamu Minato and Kikuji Sato was presented wherein a threshold controlling circuit which can automatically set a circuit threshold voltage free from the fluctuations in device fabrication processes, by adjusting the substrate voltage of a MOSIC chip with a negative feedback. Also, in the 1994 Custom Integrated Circuit Conference of IEEE, an article entitled "Self-Adjusting Threshold-Voltage Scheme (SATS) for Low-Voltage High-Speed Operation" by Tsuguo Kobayashi and Takayasu Sakurai was presented wherein the threshold voltage fluctuations were reduced by self-substrate-biasing technique. A major difficulty with the techniques set fourth in these papers is that the transistor body is biased in the wrong direction or sense, e.g. negatively, with respect to ground, for n-channel transistors and thus requires an extra power supply and a more complex controller.

SUMMARY OF THE INVENTION

The present invention increases the speed of integrated circuits, particularly with small power supply voltages and thus maintains low power consumption while maintaining high reliability. The present invention biases the transistor body only positively, with respect to ground, for n-channel transistors and only negatively, with respect to the supply voltage, for p-channel transistors thus simplifying the prior art and eliminating the cost of an extra power supply.

DETAILED DESCRIPTION OF THE PREFERRED EMBODIMENTS

The present invention performs equally well for both p-channel and n-channel transistors and, as will be explained, the circuits employed for p-channel transistors are substantially the same as those employed for n-channel transistors except that p-channel and n-channel transistors operate in opposite senses.

Figure 1:
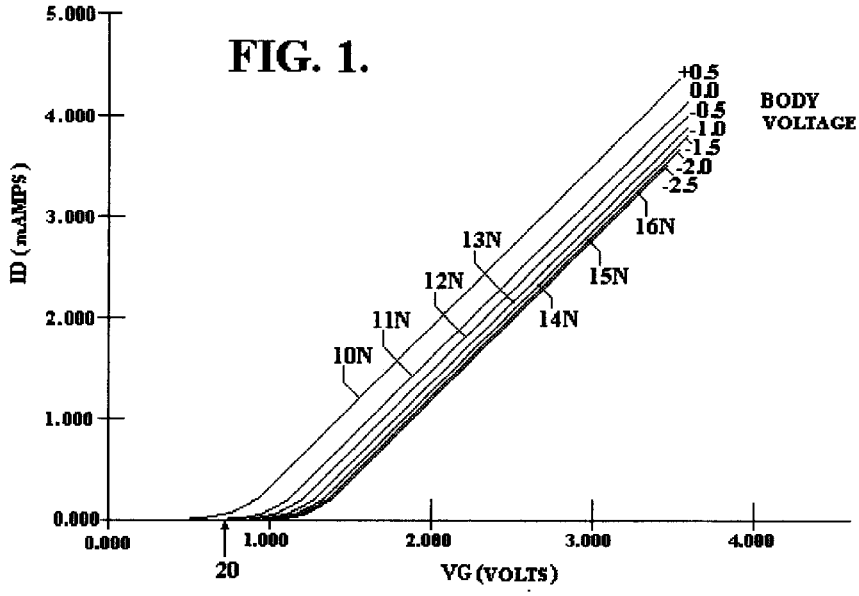
FIG. 1 shows a graph of the gate voltage vs. drain current characteristics of an n-channel FET at various body voltages.

FIG. 1 shows the actual effect of the body voltage on the gate voltage/drain current characteristics of an n-channel FET. The characteristic curve at a +0.5 body voltage, is shown by a curve 10N, at a 0.0 body voltage by a curve 11N, at a −0.5 body voltage by a curve 12N, at a −1.0 body voltage by a curve 13N, at a −1.5 body voltage by a curve 14N, at a −2.0 body voltage by a curve 15N and at a −2.5 body voltage by curve 16N. (All body voltages are with respect to the source). Note that at a nominal 0.0 body voltage, the threshold voltage (i.e. the gate voltage at which the transistor turns on) is about 0.7 volts, as seen by arrow 20.

Figure 2:
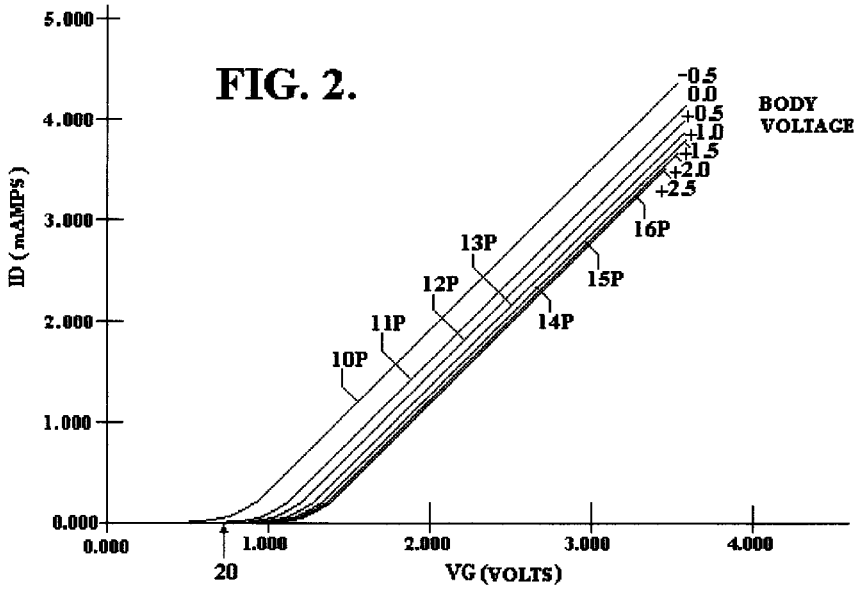
FIG. 2 shows a graph of the gate voltage vs. drain current characteristics of a p-channel FET at various body voltages.

For p-channel FETs, the effect of the body voltage on the gate voltage/drain current characteristics is approximately the same as for n-channel FETs, except for the sign convention appropriate to p-channel FETs as is seen in FIG. 2. In FIG. 2, the body voltages are all with respect to the source and at a −0.5 body voltage the characteristic curve is shown for curve 10P, at a 0.0 body voltage by a curve 11P, at a +0.5 body voltage by a curve 12P, at a +1.0 body voltage by a curve 13P, at a +1.5 body voltage by a curve 14P at a +2.0 body voltage by a curve 15P and at a +2.5 body voltage by curve 16P. Again, note that at a nominal 0.0 body voltage, the threshold voltage (i.e. the gate voltage at which the transistor turns on) is about 0.7 volts, as seen by arrow 20. (As used herein, the threshold value of an enhancement mode p-channel transistor is considered to be positive).

In the present invention, I apply only positive voltages to the body of the n-channel transistors, as, for example, between 0.0 volts and +0.5 volts (i.e. between curves 11N and 10N in FIG. 1), and thus the threshold voltage is controlled to below about 0.7 volts (arrow 20). Similarly, I apply only negative voltages to the body of the p-channel transistors as, for example, between 0.0 volts and −0.5 volts (i.e. between curves 11P and 10P in FIG. 2), and thus the threshold voltage is also controlled to below about 0.7 volts (arrow 20).

Figure 3:
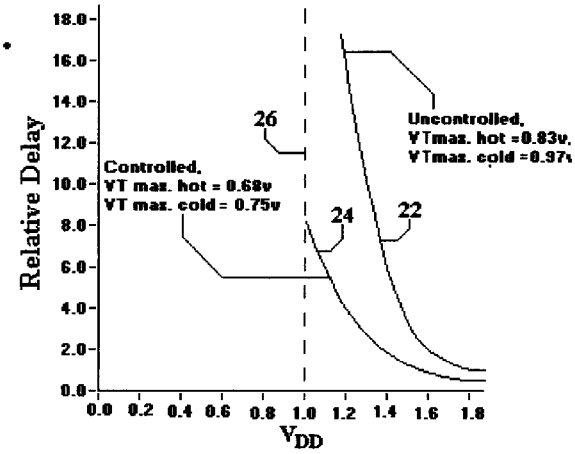
FIG. 3 shows a graph of relative gate delay vs. supply voltage, with and without the adaptive threshold voltage control of the present invention; and, FIG. 4 shows a schematic diagram of the present invention.

FIG. 3, which is applicable to both n-channel transistors and p-channel transistors, shows the worst-case normalized gate Relative Delay vs. supply voltage, $V_{DD}$ for a CMOS logic gate with and without the present invention. The worst-case variations in threshold voltages for Honeywell Silicon on Insulator (SOI) transistors were used to obtain the values shown. A temperature range of −55 degrees to +125 degrees Celsius was used. A curve 22 shows the test without the present invention and it will be noted that the delay varies from about 1.0 unit to about 30 or 40 units (off the scale) as the applied voltage, $V_{DD}$ approaches 1.0. Curve 24 shows the test when using the present invention and it will be noted that the delay now varies from about 0.7 units to about 8.0 units. With the present invention, it was found that the maximum threshold voltage was about 0.68 volts at +125 degrees C. and the minimum threshold voltage was about 0.75 volts at −55 degrees C. Note also that with a $V_{DD}$ at 1.8 volts, the delay is reduced by about 30%, with a $V_{DD}$ at 1.5 volts, the delay is reduced by about 40% and with a $V_{DD}$ at 1.2 volts, the delay is reduced by about a factor of 7, with the present invention. Thus, the present invention allows the use of a supply voltage of as low as 1.0 volt, shown by dashed line 26, whereas, with a supply voltage at 1.0 volt, the speed is impractically slow without the present invention.

Figure 4:
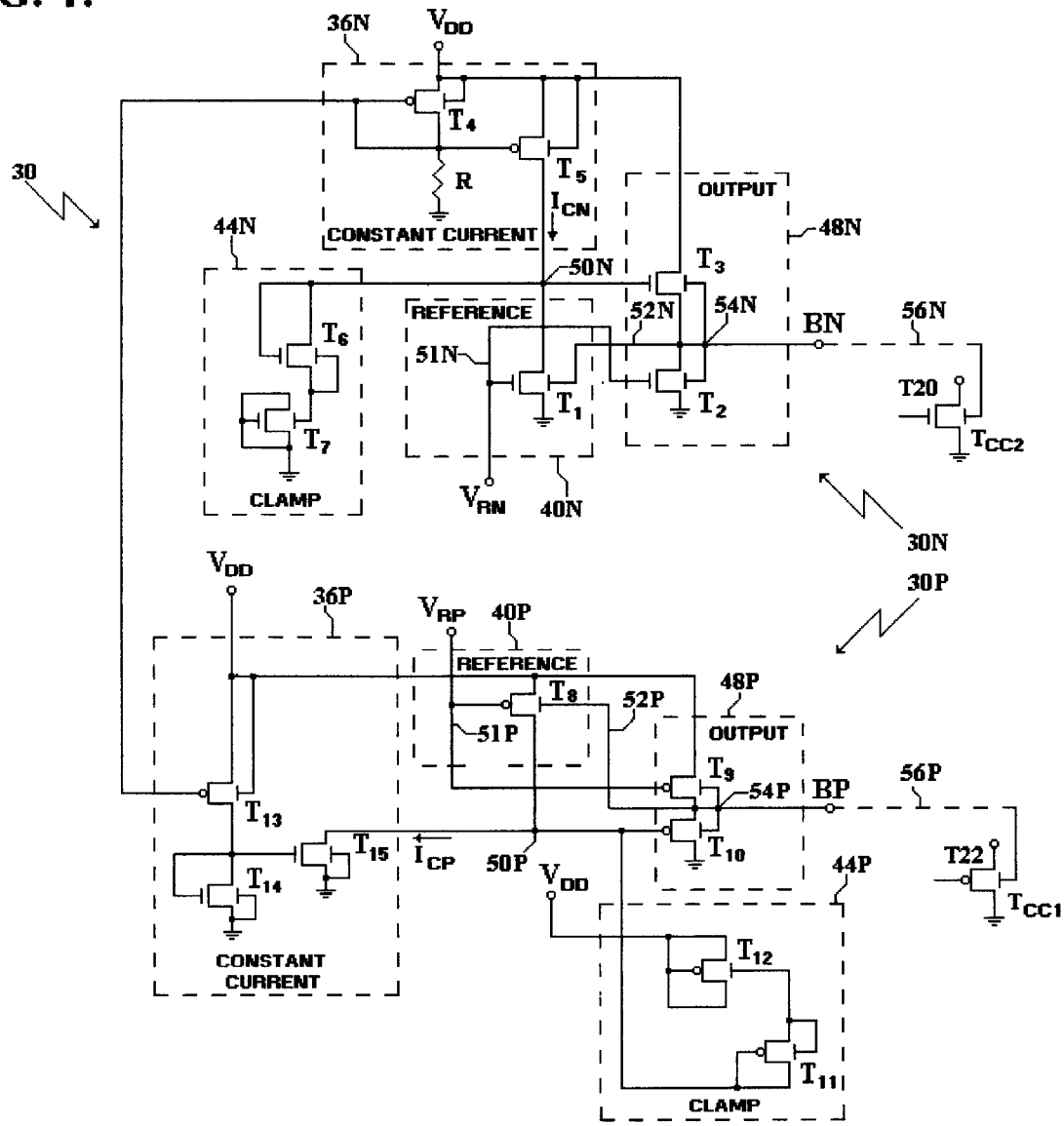

FIG. 4 shows a schematic diagram of a preferred embodiment of the present invention using CMOS transistors of both the p-channel and n-channel types. In FIG. 4, the upper portion of the controller is the n-channel controller, 30N producing an output BN and the lower portion of the controller is the p-channel controller, 30P, producing an output BP. Both the upper and lower portions utilize four basic sub-circuits: 1) constant current sources, shown by dashed line boxes 36N and 36P respectively, 2) reference voltage circuits shown by dashed line boxes 40N and 40P respectively, 3) clamping circuits shown by dashed line boxes 44N and 44P respectively, and 4) output circuits shown by dashed line boxes 48N and 48P respectively.

The constant current sources 36N and 36P are common circuits well known in the prior art and will not be described in detail. The constant current produced by the source 36N is labeled Icn and the constant current produced by 36P is labeled Icp. It is noted that because of the sign convention for p-channel transistors and n-channel transistors, Icn is shown flowing out of the constant current source 36N while Icp is shown flowing into the constant current source 36P. Except for the use of n-channel transistors in the n-channel controller, 30N and p-channel transistors in p-channel controller, 30P the remaining portions of controller 30 are the same, i.e. reference circuit 40P is like reference circuit 40N, the clamping circuit 44P is like clamping circuit 44N and output circuit 48P is like output circuit 48N. Accordingly, p-channel controller, 30P, and n-channel controller, 30N, operate in the same fashion except in the opposite sense.

As mentioned, the n-channel controller uses biases that are controlled with positive, rather than negative voltages applied to the body terminals of the transistors, (i.e. between curves 11N and 10N of FIG. 1). In the prior art, the n-channel transistors start with threshold values that are too low so that a negative voltage must be applied to the body in order for it to increase the threshold to the desired value. This requires an additional power supply. In the present invention, the n-channel transistors start with threshold values that range from just right to too high and the voltage to the body is increased, rather than decreased, to get the desired threshold without requiring an additional power source.

In FIG. 4, the constant current source 36N of the n-channel controller 30N is shown receiving the supply voltage $V_{DD}$ and producing the constant current Icn to a junction point 50N. Junction point 50N, in turn, is connected to a) the drain terminal of a transistor T1 in the reference circuit 40N, b) the gate terminal of a transistor T3 in the output circuit 48N and c) both the gate and drain terminals of a transistor T6 in the clamp circuit 44N. Clamp circuit 44N also contains a transistor T7 having a body terminal connected to the body and source terminals of transistor T6 and a source terminal, gate terminal and drain terminal all connected to ground. A reference voltage $V_{RN}$ is applied via a line, 51N, to the gate terminal of transistor T1 in the reference circuit 40N, and to the gate terminal of a transistor T2 in the output circuit 48N. The voltage on the body of T1 is connected by a line 52N to a) the drain terminal of transistor T2, b) the source terminal of transistor T3, c) the body terminals of both transistors T2 and T3 at a junction point 54N in the output circuit 48N and d) to the output BN. The voltage at junction point 54N is the feedback voltage from the output circuit 48N and supplies the body terminal of transistor T1 and the output, BN, of the controller 30N. It is presumed that the n-channel transistors of the rest of the integrated circuit will operate in substantially the same way as the n-channel transistor T1 which, as will be shown, supplies a body voltage of magnitude necessary to obtain the desired threshold for transistor T1 and thus for the other n-channel transistors in the integrated circuit. Accordingly, the output BN is used to connect the n-channel transistors in the printed circuit, represented by transistor T20, to supply the threshold controlling voltage as is shown by dashed line 56N.

As mentioned, in the p-channel controller the bias voltages are controlled with negative voltages applied to the body terminals of the transistors, (i.e. between curves 11P and 10P of FIG. 2). In the present invention, the p-channel transistors start with threshold values that range from just right to too low with respect to the power supply, $V_{DD}$, and the voltage to the body is decreased, rather than increased, to get the desired threshold without requiring an additional power source.

The constant current source 36P of the p-channel controller 30P is slightly different than the constant current source 36N in that transistors T13 and T14 are located where the resistor R was placed in the constant current source 36N. This circuit is also well known in the art and will not be described in detail. Constant current source 36P is shown receiving the supply voltage $V_{DD}$ and producing the constant current Icp connected to a junction point 50P. Junction point 50P, in turn, is connected to a) the drain terminal of a transistor T8 in the reference circuit 40P, b) the gate terminal of a transistor T10 in the output circuit 48P and c) both the gate and drain terminals of a transistor T11 in the clamp circuit 44P. Clamp circuit 44P also contains a transistor T12 having a body terminal connected to the body and source terminals of transistor T11 and a source terminal, gate terminal and drain terminal all connected to the power supply $V_{DD}$. A reference voltage $V_{RP}$ is applied via a line, 51P, to the gate terminal of transistor T8 in the reference circuit 40P, and to the gate terminal of a transistor T9 in the output circuit 48P. The voltage on the body terminal of transistor T8 is connected by a line 52P to a) the drain terminal of transistor T9, b) the source terminal of transistor T10, c) the body terminals of both transistors T9 and T10 at a junction point 54P in the output circuit 48P and d) to the output BP. The voltage at junction point 54P is the feedback voltage from the output circuit 48P and supplies the body terminal of transistor T8 and the output, BP, of the controller 30N. It is presumed that the p-channel transistors of the rest of the integrated circuit will operate in substantially the same way as the p-channel transistor T8 which, as will be shown, supplies a body voltage of magnitude necessary to obtain the desired threshold for transistor T8 and thus for the other p-channel transistors in the integrated circuit. Accordingly, the output BP is used to connect the p-channel transistors in the printed circuit, represented by transistor T22 to supply the threshold controlling voltage as is shown by dashed line 56P.

In operation of the n-channel controller 30N, if it is assumed, for example, that the threshold voltage of T1 is, say 0.6 volts and the reference voltage $V_{RN}$, is 0.5 volts, then T1 will be "off" and the voltage at the gate of transistor T3 will begin increasing due to the current Icn into junction point 50N. The feedback, i.e. body voltage of transistor T1, at junction point 54N, will begin to increase positively and, as seen in FIG. 1, as the body voltage increases, the threshold voltage goes down.

When the feedback voltage reaches the reference voltage, $V_{RN}$, i.e. 0.5 volts, transistor T1 will be turned "on" and the constant current, Icn, will now begin to flow through transistor T1. This reduces the voltage to the gate of transistor T3 and the output at junction point 54N will start decreasing. An equilibrium will be reached when the body voltage on transistor T1 is just high enough to maintain the voltage to the gate of transistor T3 at a value which maintains the current flow through transistor T1 and to the gate of transistor T3 at a constant level. At this point, the threshold of transistor T1 (and all of the n-channel transistors such as T20 of the integrated circuit) will be at the desired threshold. It should be noted that by changing the value of $V_{RN}$, the desired threshold voltage can be changed. Because of this, one can obtain multiple different values for the threshold voltage on the same chip and may change the threshold voltage of a given part type without process changes.

The clamp 44N may not be necessary, but in some cases, the increase of the body voltage to transistor T1 may never get high enough to reach an equilibrium. In this event, clamp 44N will put a stop to the increase. It is seen that transistors T6 and T7 receive the same voltage as the gate of transistor T3 and act rather like two diodes connected in series. Thus, when the voltage at junction point 50N reaches a predetermined value, current will flow through clamp 44N to ground and prevent the body voltage to transistor T1 from further increasing. While the threshold voltage reached at that point may not be ideal for the n-channel transistors, it will still be a considerably lower threshold than would be the case without the present invention.

In operation of the p-channel controller 30P, if it is assumed, for example, that the threshold voltage of T8 is, say 0.6 volts and the reference voltage $V_{RP}$, is 0.5 volts below $V_{DD}$, then T8 will be "off" and the voltage at the gate of transistor T10 will begin decreasing due to the current Icn out of junction point SOP. The feedback, i.e. the body voltage of transistor T8, at junction point 54P, will begin to decrease negatively, and, as seen in FIG. 2, as the body voltage decreases, the threshold voltage goes down.

When the feedback voltage reaches the reference voltage $V_{RP}$, i.e. 0.5 volts, transistor T8 will be turned "on" and the constant current, Icp, will now begin to flow through transistor T8. This increases the voltage to the gate of transistor T10 and the output at junction point 54P will start increasing. An equilibrium will be reached when the body voltage on transistor T8 is just high enough to maintain the voltage to the gate of transistor T10 at a value which maintains the current flow through transistor T8 and from the gate of transistor T10 at a constant level. At this point, the threshold of transistor T8 (and all of the p-channel transistors such as T22 of the integrated circuit) will be at the desired threshold. It should be noted that by changing the value of $V_{RP}$, the desired threshold voltage can be changed. Because of this, one can obtain multiple different values for the threshold voltage on the same chip and may change the threshold voltage of a given part type without process changes.

As with claim 44N, the clamp 44P may not be necessary, but in some cases, the decrease of the body voltage to transistor T8 may never get low enough to reach an equilibrium. In this event, clamp 44P will put a stop to the decrease. It is seen that transistors T11 and T12 receive the same voltage as the gate of transistor T10 and act rather like two diodes connected in series. Thus, when the voltage at junction point 50P reaches a predetermined value, current will flow through clamp 44P to $V_{DD}$ and prevent the body voltage to transistor T8 from further decreasing. While the threshold voltage reached at that point may not be ideal for the p-channel transistors, it will still be a considerably lower threshold than would be the case without the present invention It is seen that the p-channel controller operates the same as the n-channel controller except that the voltage produced by the output circuit 40P is negative with respect to the supply voltage and the reference circuit 40P responds to the negative feedback voltage to produce a negative bias to the bodies of the p-channel transistors and produce a decreased absolute value for the threshold voltage, which in the case of a p-channel transistor, will also operate to increase the speed of operation.

It is thus seen that I have provided an improved threshold voltage supply with negative feedback to supply a positive bias to the bodies of an n-channel transistors and a negative bias to the bodies of p-channel transistors thus increasing the speed without requiring an additional power supply. Many changes will occur to those having skill in the art. For example, constant current sources other than 36P and 36N may be used, clamps other than 44P and 44N may be substituted and output circuits other than the circuit 48P and 48N may be employed so long as the feedback voltage to the body of the reference transistor T1 is controlled in a manner such as described herein. I therefore do not wish to be limited to the specific descriptions used in connection with the preferred embodiment. The scope of the present invention is determined by the appended claims.

What is claimed is:

1. A CMOS transistor threshold value controller comprising:

a reference transistor having a body, the voltage on which can be varied in a first direction to decrease the threshold voltage of the reference transistor;

a feedback circuit operable to produce a feedback voltage which increases in the first direction; and means connecting the body of the reference transistor to receive the feedback voltage to decrease the threshold of the reference transistor to a desired value.

2. Apparatus according to claim 1 wherein the increase of feedback voltage to the reference transistor operates to reduce the magnitude of the feedback voltage until an equilibrium is reached where the threshold is maintained at the desired value by the feedback voltage.

3. Apparatus according to claim 1 wherein the controller is an n-channel transistor threshold value controller, the reference transistor is an n-channel transistor having a body, the direction is positive, and the feedback circuit is operable to produce a positive voltage.

4. The controller of claim 3 further including a source of reference voltage and the reference transistor has a gate electrode that is connected to the source of reference voltage.

5. The controller of claim 4 further including a source of constant current and the reference transistor has a drain electrode connected to the source of constant current.

6. The controller of claim 5 wherein the feedback circuit includes a first output transistor having a gate electrode connected to the source of constant current.

7. The controller of claim 6 wherein the feedback circuit includes a second output transistor having a gate electrode connected to the source of reference voltage.

8. The controller of claim 7 wherein the second output transistor has a source electrode connected to ground.

9. The controller of claim 8 further including a source of supply voltage and the first output transistor includes a drain electrode connected to the source of supply voltage.

10. The controller of claim 9 wherein the first output transistor includes a source electrode, the second output transistors includes a drain electrode connected to the source electrode of the first output transistor and both the first and second output transistors include a body connected to the body of the reference transistor to supply the positive voltage thereto.

11. The controller of claim 10 further including an output terminal connected to the body of the reference transistor to supply the positive voltage to downstream n-channel transistors.

12. The controller of claim 11 further including a clamp connected to the gate electrode of the first output transistor to prevent the positive voltage to the body of the reference transistor from exceeding a predetermined value.

13. The controller of claim 3 further including a clamp connected to the feedback circuit to prevent the positive voltage from exceeding a predetermined value.

14. Apparatus according to claim 1 wherein the controller is a p-channel transistor threshold value controller, the reference transistor is a p-channel transistor having a body, the direction is negative, and the feedback circuit is operable to produce a negative voltage.

15. The controller of claim 14 further including a source of reference voltage and the reference transistor has a gate electrode that is connected to the source of reference voltage.

16. The controller of claim 15 further including a source of constant current and the reference transistor has a drain electrode connected to the source of constant current.

17. The controller of claim 16 wherein the feedback circuit includes a first output transistor having a gate electrode connected to the source of constant current.

18. The controller of claim 17 wherein the feedback circuit includes a second output transistor having a gate electrode connected to the source of reference voltage.

19. The controller of claim 18 wherein the first output transistor has a drain electrode connected to ground.

20. The controller of claim 19 further including a source of supply voltage and the second output transistor includes a source electrode connected to the source of supply voltage.

21. The controller of claim 20 wherein the first output transistor includes a source electrode, the second output transistors includes a drain electrode connected to the source electrode of the first output transistor and both the first and second output transistors include a body connected to the body of the reference transistor to supply the negative voltage thereto.

22. The method of controlling the threshold of an CMOS transistor to increase speed while maintaining power consumption including a reference transistor having a source electrode, a gate electrode, a drain electrode and a body, with a voltage on the body that produces a decreased threshold when the voltage increases in a first direction, and a feedback circuit comprising the steps of:

A. connecting a feedback circuit to produce a feedback voltage that increases in the first direction; and B. connecting the body of the reference transistor to receive the feedback voltage from the feedback circuit to decrease the threshold of the reference transistor to a desired value.

23. The method of claim 22 further including the step of:

C. providing a source of reference voltage to the gate electrode of the reference transistor.

24. The method of claim 23 further including the step of:

D. providing a source of constant current to the drain electrode of the reference transistor.

25. The method of claim 24 wherein the feedback circuit includes a first output transistor having a source electrode, a gate electrode, a drain electrode and a body and further including the step of:

E. connecting the gate electrode of the first output transistor to the source of constant current.

26. The method of claim 25 wherein the feedback circuit includes a second output transistor having a source electrode, a gate electrode, a drain electrode and a body and further including the step of:

F. connecting to the gate electrode of the second output transistor to the source of reference voltage.

27. The method of claim 26 including a source of supply voltage and further including the step of:

G. connecting the source electrode of the second output transistor to ground for n-channel transistors and to the source of supply voltage for p-channel transistors.

28. The method of claim 27 further including the step of:

H. connecting the drain electrode of the second output transistor and the bodies of the first and second output transistors to the body of the reference transistor to supply the feedback voltage thereto.

29. The method of claim 28 further including the step of:

I. connecting the body of the reference transistor to an output terminal to supply the feedback voltage to downstream CMOS transistors.

30. The method of claim 29 further including a clamp and further including the step of connecting the gate electrode of the first output transistor to the clamp to prevent the voltage to the body of the reference transistor from exceeding a predetermined value.

31. The method of claim 22 including a clamp and further including the step of:

J. connecting the feedback circuit to the clamp to prevent the voltage from exceeding a predetermined value.

32. A threshold controller comprising:

a supply voltage source;

a first source of reference voltage;

a first constant current source;

a first reference circuit, the first reference circuit including an n-channel transistor having a grid electrode connected to the first source of reference voltage, and having a source electrode, a drain electrode and a body;

a first output circuit including first and second n-channel output transistors each having a source electrode, a grid electrode, a drain electrode and a body;

means connecting the bodies of the first and second transistors in the first output circuit to the source electrode of the first transistor of the first output circuit and to the drain electrode of the second transistor of the first output circuit;

means connecting the body of the transistor in the first reference circuit to the bodies of the first and second transistors of the first output circuit;

a second reference circuit including a p-channel transistor having a source electrode, a grid electrode, a drain electrode and a body;

a second source of reference voltage;

a second constant current source;

a second reference circuit, the second reference circuit including an p-channel transistor having a gate electrode connected to the second source of reference voltage, and having a source electrode, a drain electrode and a body;

a second output circuit including first and second p-channel output transistors each having a source electrode, a grid electrode, a drain electrode and a body;

means connecting the bodies of the first and second transistors in the second output circuit to the source electrode of the first transistor of the second output circuit and to the drain electrode of the second transistor of the second output circuit;

means connecting the body of the transistor in the second reference circuit to the bodies of the first and second transistors of the second output circuit;

means connecting the drain electrode of the p-channel transistor in the reference circuit and the gate electrode of the first transistor in the output circuit to the constant current source;

means connecting the gate electrode of the transistor of the reference circuit and the grid electrode of the second transistor of the output circuit to the source of reference voltage; and, output means connected to the bodies of the transistors in the reference circuits respectively, to provide signals to n-channel and p-channel transistors downstream.

* * * * *